United States Patent [19]

Nishimiya et al.

[11] 4,278,959

[45] Jul. 14, 1981

[54] CURRENT-STROKE PROPORTIONAL TYPE SOLENOID VALVE

[75] Inventors: Torazo Nishimiya, Mito; Masamitsu Okumura, Katsuta, both of Japan

[73] Assignee: Hitachi, Ltd., Tokyo, Japan

[21] Appl. No.: 72,462

[22] Filed: Sep. 4, 1979

[30] Foreign Application Priority Data

Sep. 4, 1978 [JP] Japan ..... 53-107606

[51] Int. Cl.[3] ..... H01F 7/08

[52] U.S. Cl. ..... 335/262; 335/251

[58] Field of Search ..... 335/262, 255, 281, 282

[56] References Cited

U.S. PATENT DOCUMENTS 3,851,285 11/1974 Rothfuss et al. ..... 335/262

FOREIGN PATENT DOCUMENTS 2330839 1/1975 Fed. Rep. of Germany ..... 335/262

*Primary Examiner*—Harold Broome

*Attorney, Agent, or Firm*—Craig & Antonelli

[57] ABSTRACT

A current-stroke proportional type solenoid valve has a movable plunger disposed around the inner peripheral wall of a bobbin with a coil therearound, a stator core disposed face to face with the movable plunger and forming the magnetic circuit, a bias spring for always biasing the movable plunger in one direction and the stroke of the movable plunger being determined by magnitude of the current flowing through the coil. In the solenoid valve, the output rod is axially supported by a first lubricant resin and the movable plunger also by a second lubricant resin.

7 Claims, 3 Drawing Figures

CURRENT-STROKE PROPORTIONAL TYPE SOLENOID VALVE

This invention relates to a device for converting a change of an electrical input to a position change of an output operative member and more particularly to a current-stroke proportional type solenoid valve the stroke of an output rod of which is proportional to a value of input current applied thereto.

In a conventional current-stroke proportional type solenoid valve (referred to as a proportional solenoid valve), it is important to reduce friction of the output rod for ensuring a high accuracy of the stroke of the output rod in proportion to a current. A measure conventionally taken for reducing the friction is that a part of the output rod is axially supported by a bearing called a linear ball bearing. In the linear ball bearing, rolling of balls in the direction of the output rod movement reduces the friction of the rod.

The application of the linear ball bearing for the proportional type solenoid valve needs special care to be taken of the supporting structure of the linear ball. The reason for this is that long term use of the solenoid valve causes balls to possibly come off and that grease sealed in the ball housing portion is thermally deteriorated thereby to damage the bearing function. These problematic facts make the solenoid valve of the linear ball bearing type improper in practical use.

Another proposal in this field is that a part of the output rod is axially supported by resin of the self-lubricating type in place of the linear ball bearing. The proposal uses a hollow tube made of, for example, nylon (trade mark) having a lubricating function, with the output rod passing through the hollow of the tube. The proposal may axially support the output rod, while being free from the above-mentioned problems attendant on the use of the linear ball bearing.

Because of a tendancey of compression of the lubricant resin resulting from a temperature change, the inner diameter of the hollow of the resin tube frequently become shorter. A conventional countermeasure taken for this is to so design the lubricant resin tube as to have the inner diameter relatively longer than the outer diameter of the output rod.

A relatively large gap thus formed between the output rod and the inner wall of the resin tube making unstable an angle or inclination of the movable plunger fixed to the output rod with respect to the axis. The result is that the reciprocal motion of the movable plunger along the operation line of the output rod and the plunger is performed in an inclined state, and that the moving movable plunger comes in contact with the wall along which the plunger moves, resulting in an extreme increase of the friction. As a consequence, a relation between the output rod and an input current, i.e. a called input-output characteristic, has a large hysterisis, leading to deterioration of the input-output characteristic.

An object of the present invention is to provide a proportional type solenoid valve with the stroke of the output rod proportional to a change of an input current, which is simple in construction and secures an accurate proportional relation between the stroke and the input current.

One of the features of the invention resides in that a part of the output rod is axially supported by lubricant resin and a part of the movable plunger fixed integrally with the output rod is axially supported by another lubricant resin. The two-point support of the output rod and the movable plunger considerably reduces the friction of the movable plunger to its guide wall, thus providing an excellent input-output characteristic.

The above and other objects, features and advantages will be apparent from the following detailed description taken in connection with the accompanying drawings, in which.

An embodiment of a proportional type solenoid valve according to the invention will be described in detail with reference to the drawings.

Figure 1:
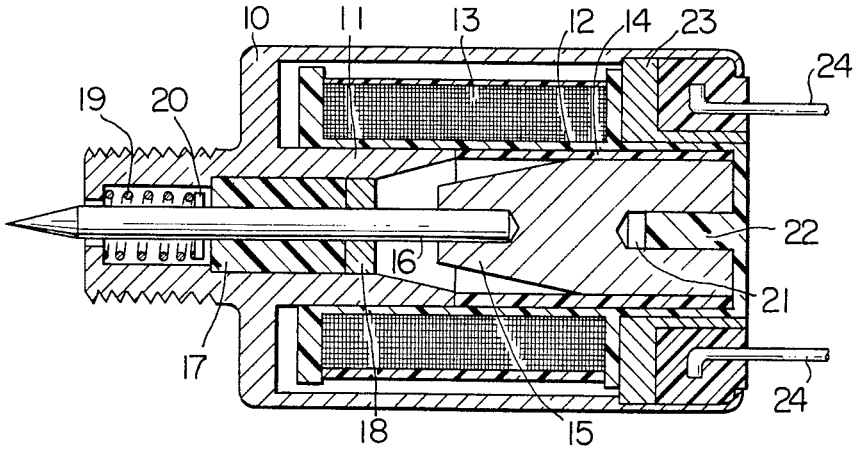
FIG. 1 shows a longitudinal cross sectional view of a proportional type solenoid valve which is an embodiment according to the invention.

FIG. 1, reference numeral 10 designates a metal case also serving as a stator core 11, having a resin bobbin 12 disposed therein. The bobbin 12 is fitted around the outer peripheral wall of the stator core 11, with an exciting coil 13 wound around the bobbin 12. Onto the inner peripheral wall of the bobbin 12 a guide tube 14 for supporting a variable plunger 15 is secured. The variable plunger 15 is slidably placed within the guide tube 14 made of resin containing solid lubricant such as molybdenum bisulfide. The leading portion of the movable plunger 15 is conically shaped in cross section while the stator core 11 is shaped like a funnel according to the shape of the plunger leading portion. The shapings of the movable plunger 15 and the stator core 11 enable an input current to proportionally change the stroke of the variable plunger 15.

As shown, the leading end of the variable plunger 15 is fixed to one end of the output shaft 16 of which the other end projects to the outside of the case 10. A part of the output rod 16 is axially supported by a lubricant bearing 17 shaped like a hollow tube. The bearing 17 is disposed within the stator core 11 and fixed by a stopper 18. A bias spring 19 with the output rod 16 passing therethrough is resiliently inserted between a ring 20 fixed to the output rod 16 and a case 10. The bias spring always biases the output rod 16 and the variable plunger 15 in one direction. The variable plunger 15 has a hole 21 formed substantially at the center in the portion not having the output rod. Slidably inserted into the hole 21 is a guide projection 22, axially supporting the movable plunger 15. In this embodiment, the guide projection 22 is formed integrally with the bobbin 12, but these may be formed individually and in use those are fitted to each other. A yoke 23 disposed near the coil 13 around the bobbin 12, the coil 13, the stator core 11, the variable plunger 15 and the yoke 23 cooperate to form a magnetic circuit. Incidently reference numeral 24 designates input terminal.

In operation, with a magnetomotive force developed by the coil 13 when a controlled current flows through the coil 13, a magnetic flux flows through a magnetic circuit having the stator core 11, the movable plunger 15 and the yoke 23. A magnetic attraction force is accordingly developed to move the movable plunger 15 toward the stator core 11, so that the output rod 16 makes a stroke to the left side as viewed in the drawing. At this time, the bias spring 19 biases the output rod and the movable plunger 15 in the opposite direction to that of the plunger motion. Therefore, the plunger 15 and the output rod 16 move to a position where the magnetic attraction force and the resilient force of the bias spring 19 counterbalance each other. Under this condition, when the input current increases, the stroke of the output rod 16 becomes long while, when it decreases, the stroke becomes short. In this way, the proportional relation holds between the input current and the output rod 16.

In the above-mentioned solenoid valve, when it is desired to have a highly corect input current-stroke relation, all one has to do is greatly reduce the friction related to the moving portions, the output rod 16 and the movable plunger 15.

As described above, the output rod 16 is axially supported by the bearing 17 of lubricant resin disposed within the stator core 11 and the movable plunger 15 is also axially supported by the guide tube 14 for guiding the movable plunger 15, or the guide hole 21 formed in the movable plunger 15 and/or the guide projection 22. Accordingly, the output rod 16 and the plunger, which are integrally coupled with each other, are axially supported at two points, so that the movable plunger 15 is stably held without being inclined. Consequently, the proportional type solenoid plunger 15 eliminates the increase of the hysterisis in the input-output characteristic arising from an extremely increased friction attributed to the plunger inclination.

Figure 2:
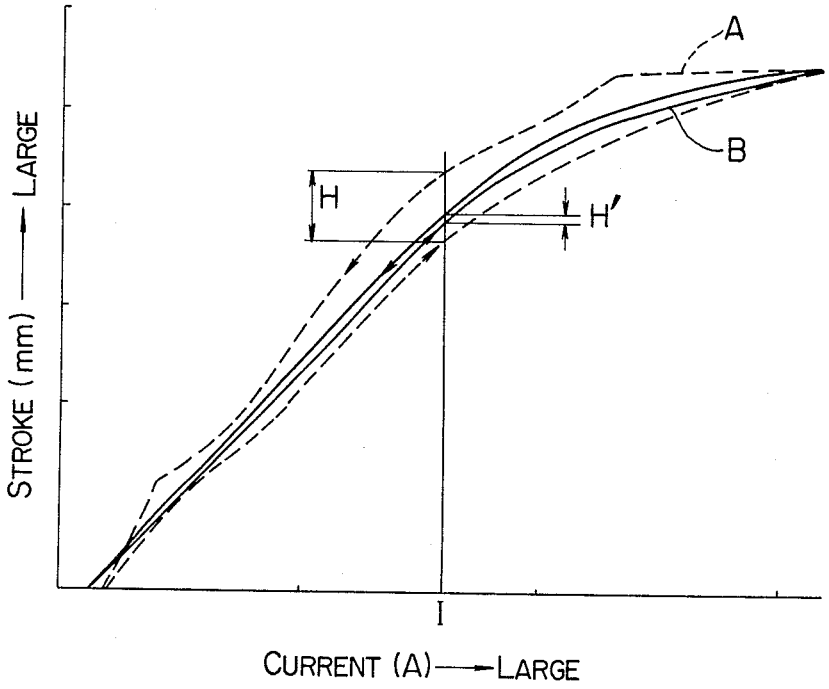
FIG. 2 shows a for illustrating input current-output rod stroke relations of the proportional type solenoid valve according to the invention and a proportional type solenoid valve only the output rod of which is supported by nylon resin.

Turning now to FIG. 2, there are shown input current-stroke characteristics of the proportional type solenoid valve according to the invention and of the conventional one only the output rod of which is axailly supported by the resin bearing.

A broken line A denotes the characteristic of the conventional valve having a large hysterisis, as shown. For example, the conventional one has "H" of the hysterisis for "I" of the current. As seen from a continuous line B respresenting the characteristic of the solenoid valve according to the invention, the hysterisis is only "H" for the same current "I", and remarkably reduced compared to the conventional one.

Figure 3:
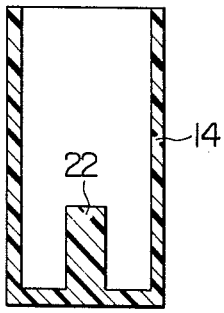
FIG. 3 shows a cross sectional view of a bearing portion of the modified proportional type solenoid valve according to the invention.

FIG. 3 shows a cross sectional view of a modification of the bearing portion of the proportional type solenoid valve according to the invention.

In the embodiment shown in FIG. 3, the guide tube 14 and the guide projection 22 are integrally formed by using lubricant resin. Those integrally formed ones are then fitted around the inner wall of the bobbin 12, thus being integral with the bobbin 12.

The integral formation of those simplifies the assembling process of the proportional type solenoid, and further forms those with precise dimensions.

As described above, in the solenoid valve according to the invention, the movable plunger including the output rod is axially supported by the two bearing of lubricant resin so that the construction of the solenoid valve is very simple with small hysterisis.

What we claim is:

1. A current-stroke proportional type solenoid valve having a movable plunger disposed around the inner peripheral wall of a bobbin with a coil therearound, a stator core disposed face to face with the movable plunger and forming the magnetic circuit, a bias spring for always biasing the movable plunger in one direction , and the stroke of the movable plunger being determined by magnitude of the current flowing through the coil, wherein said output rod is axially supported by a first lubricant resin bearing and said movable plunger is axially supported by a second lubricant resin bearing, wherein said second resin bearing is a guide projection made of lubricant resin secured to the bobbin, being slidably inserted into a guide hole formed in the portion of said movable plunger not having the output rod fixed thereto.

2. A current-stroke proportional solenoid valve according to claim 1, wherein said guide projection and said bobbin are integrally formed.

3. A current-stroke proportional solenoid valve having a movable plunger disposed around the inner peripheral wall of a bobbin with a coil therearound, a stator core disposed face to face with the movable plunger and forming the magnetic circuit, a bias spring for always biasing the movable plunger in one direction, and the stroke of the movable plunger being determined by magnitude of the current flowing through the coil, wherein said output rod is axially supported by a first lubricant resin bearing and said movable plunger is axially supported by a second lubricant resin bearing, wherein said second resin bearing is a guide tube made of lubricant resin which is fitted around the inner peripheral wall of said bobbin and through which said movable plunger is slidable.

4. A current-stroke proportional solenoid valve according to claim 3, wherein said guide tube is made of resin containing solid lubricant.

5. A current-stroke proportional solenoid valve according to claim 4, wherein said solid lubricant is molybdenum bisulfide.

6. A current-stroke proportional solenoid valve having a movable plunger disposed around the inner peripheral wall of a bobbin with a coil therearound, a stator core disposed face to face with the movable plunger and forming the magnetic circuit, a bias spring for always biasing the movable plunger in one direction, and the stroke of the movable plunger being determined by magnitude of the current flowing through the coil, wherein said output rod is axially supported by a first lubricant resin bearing and said movable plunger is axially supported by a second lubricant resin bearing, wherein said second resin bearing is the combination of a guide tube made of lubricant resin which is fitted around the inner wall of said bobbin and through which said movable plunger is slidably disposed and a projection of lubricant resin which is slidably inserted in a guide hole formed in the portion of said movable plunger not having the output rod fixed thereto.

7. A current-stroke proportional solenoid valve according to claim 6, wherein said guide tube and said guide projection are integrally formed.

* * * * *